United States Patent [19]

Hoenigmann

[11] 4,002,332

[45] Jan. 11, 1977

[54] AUTOMATIC FEED MECHANISM FOR POWER BRAKE OR THE LIKE

[75] Inventor: Gustave Hoenigmann, Ridgewood, N.Y.

[73] Assignee: Acme Steel Door Corporation, Brooklyn, N.Y.

[22] Filed: Apr. 9, 1975

[21] Appl. No.: 566,173

[52] U.S. Cl. ..... 271/11; 214/15; 214/8.5 D; 271/103

[51] Int. Cl.[2] ..... B65H 3/08; B65H 5/06; B65H 5/04

[58] Field of Search ..... 271/14, 11, 225, 5, 271/12, 13, 103, 10; 214/8.5 P, 16.4 C, 15, 16 B, 8.5 A; 100/215; 72/419, 428; 83/281, 280

[56] References Cited

UNITED STATES PATENTS

| | | | |
|---|---|---|---|
| 2,726,775 | 12/1955 | Howard | 214/16.4 C |
| 2,849,231 | 8/1958 | Reguly et al. | 271/11 |
| 3,201,113 | 8/1965 | Lee et al. | 271/5 |
| 3,404,790 | 10/1968 | Brookhyser | 214/8.5 A |
| 3,485,393 | 12/1969 | Wilder | 271/103 X |

*Primary Examiner*—Evon C. Blunk
*Assistant Examiner*—Bruce H. Stoner, Jr.
*Attorney, Agent, or Firm*—Kane, Dalsimer, Kane, Sullivan and Kurucz

[57] ABSTRACT

An automatic feed mechanism for sheet steel forming equipment such as a power brake or the like is provided. The mechanism comprises essentially four sections. The first section provides a support for a stack of sheets to be fed to the power brake. The second section contains a suction cup and actuating cylinders for lifting a sheet vertically from the stack and for transporting the sheet horizontally to a roller. The third section comprises a roller upon which the sheet is transported horizontally to a lifting bed at the fourth section and a drive for the roller. The fourth section of the mechanism comprises a lifting station positioned adjacent the power brake. The lifting station includes an elevator for engaging the ends of the sheet to raise the sheet from a first level equal to that of the level of the rollers to a second level substantially equal to that of the input to the power brake. The elevator provides sufficient support for the sheet in the raised position so that a single operator can feed the sheet into the power brake for forming.

8 Claims, 8 Drawing Figures

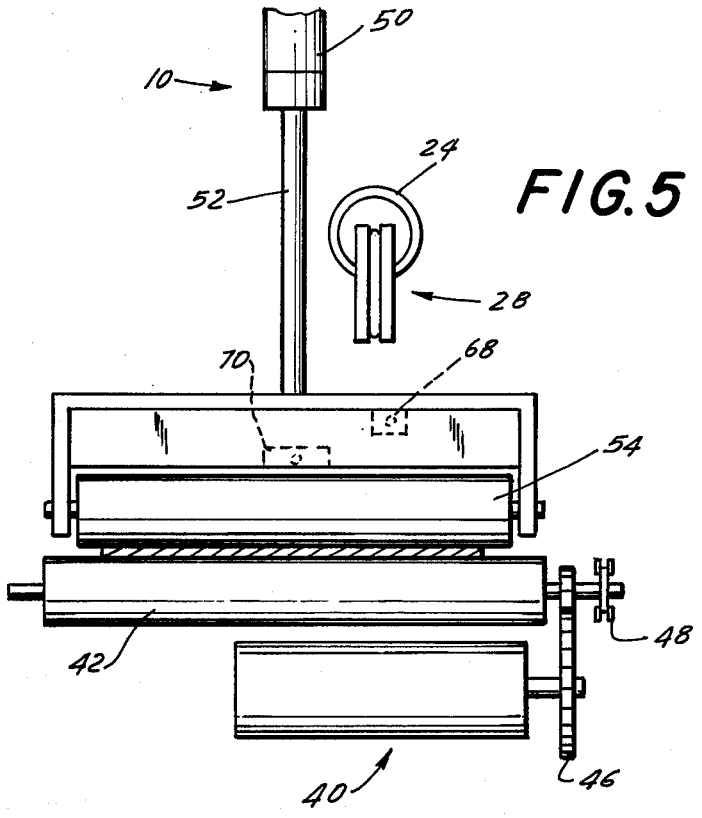
FIG. 5
FIG. 4
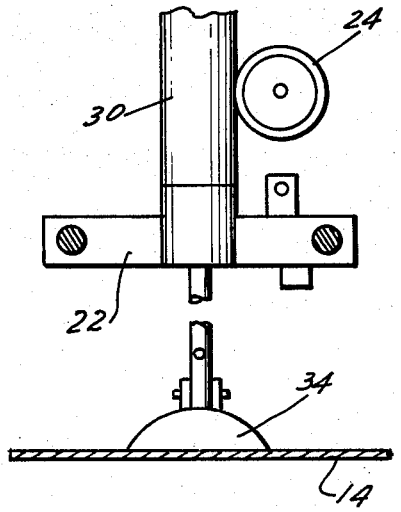

FIG. 6
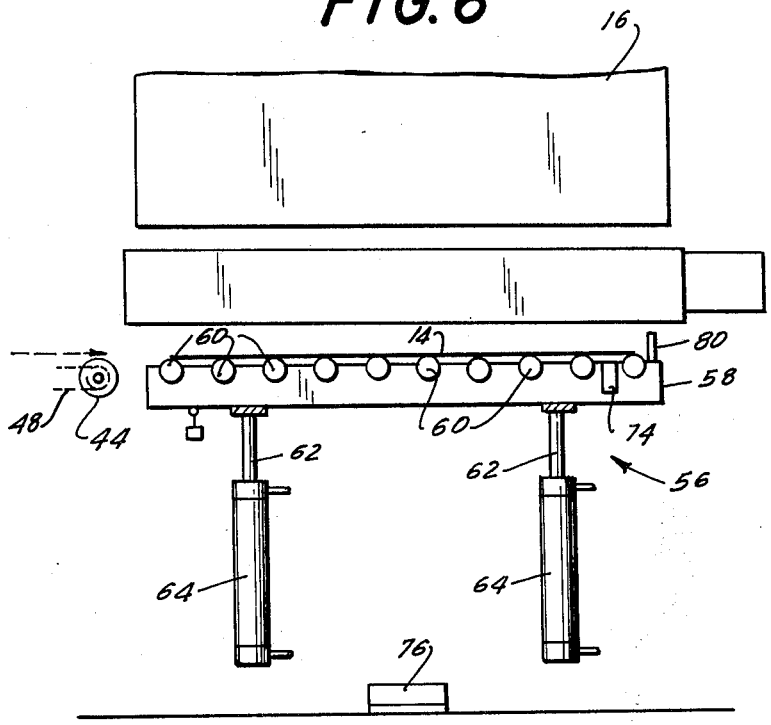
FIG. 7
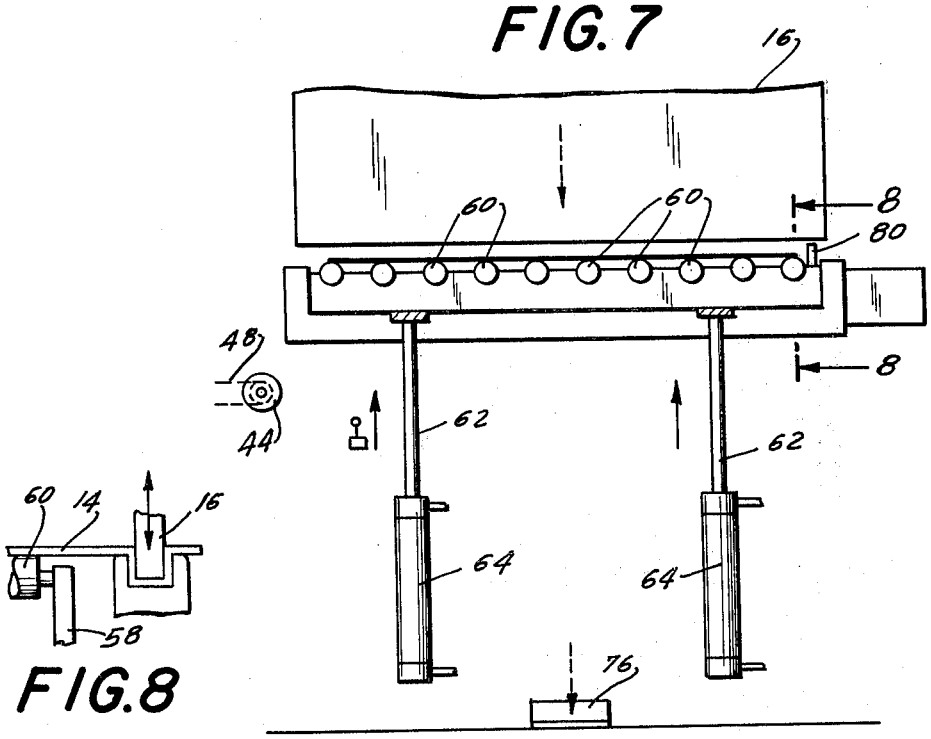
FIG. 8

AUTOMATIC FEED MECHANISM FOR POWER BRAKE OR THE LIKE

BACKGROUND OF THE INVENTION

The present invention relates to material handling equipment and more particularly to a feed mechanism for automatically feeding sheet steel or the like to a power brake or other similar metal forming equipment.

Heretofore, it has been the practice in the sheet steel forming industry to feed such sheets to power brakes and other forming machines by hand. Where the sheet was relatively long (i.e., in excess of three or four feet), this usually required that two men, one at each end of the sheet, feed the sheet into the press brake and remove it from the brake after bending was completed. As a result, the labor cost involved in utilizing two men was reflected in the cost of the final product. In addition, the fact that two workmen were involved in feeding the sheet steel to the brake increased the possibility of an accident occurring.

In view of the above, it is the principal object of the present invention to provide a feed mechanism for such equipment which enables one workman to do the job that previously required two.

SUMMARY OF THE INVENTION

The above and other beneficial objects and advantages are attained in accordance with the present invention by providing an automatic feed mechanism for sheet steel forming equipment such as a power brake or the like. The mechanism comprises essentially four sections. The first section provides means for supporting a stack of sheets to be fed to the power brake. The second section contains means for lifting a sheet vertically from the stack and for transporting the sheet horizontally to a roller. The third section comprises a roller upon which the sheet is transported horizontally to a lifting bed at the fourth section. The fourth section of the mechanism comprises a lifting station positioned adjacent the power brake. The lifting station includes elevator means for engaging the ends of the sheet to raise the sheet from a first level equal to that of the level of the rollers to a second level substantially equal to that of the input to the power brake. The elevator provides sufficient support for the sheet in the raised position so that a single operator can feed the sheet into the power brake for forming.

BRIEF DESCRIPTION OF THE DRAWINGS

In the accompanying drawings:

FIG. 4 is a sectional view taken along reference lines 4—4 of FIG. 3 in the direction indicated by the arrows;

FIG. 5 is a sectional view taken along reference lines 5—5 of FIG. 3 in the direction indicated by the arrows;

FIGS. 6 and 7 are diagrammatic representations of the lifting station of the mechanism during various stages of its operation; and, FIG. 8 is a sectional view taken along reference line 8—8 of FIG. 7 in the direction indicated by the arrows.

DETAILED DESCRIPTION OF THE PREFERRED EMBODIMENT

Figure 1:
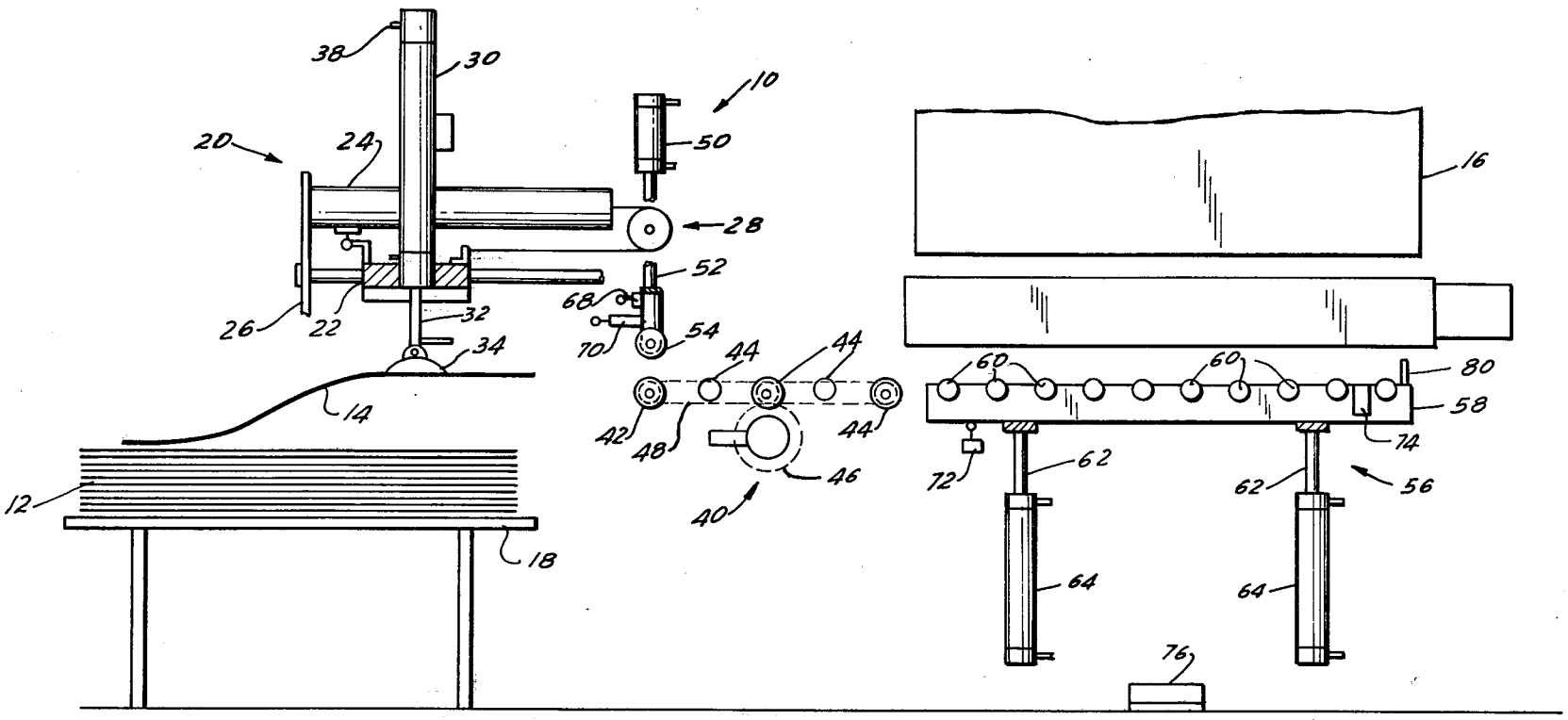
FIG. 1 is a diagrammatic representation of an automatic feed mechanism in accordance with the present invention.

Reference is now made to the drawings wherein similar components bear the same reference numerals throughout the several views. In FIG. 1 an automatic feed mechanism 10 in accordance with the present invention is shown feeding a stack 12 of sheets 14 of steel or the like to a power bending brake 16. It should be realized at the outset that the mechanism 10 could be utilized in the same fashion to feed the sheets to equipment other than a power brake and that the power brake 16 is merely representative of the type of sheet forming equipment to be fed.

Mechanism 10 comprises essentially four sections. The first section consists of a table or bed 18 for supporting a stack of sheets 14 to be fed to the power brake. The bed may include side guards or the like to ensure the proper alignment of the sheets.

The second section of the mechanism is generally designated by the numeral 20. This section includes a trolley 22 which is horizontally movable along a track 24 secured to the main frame 26 of the mechanism. The trolley is driven by a cable and drive mechanism generally designated by the numeral 28. A cylinder 30 is mounted to the trolley for movement therewith. A piston 32 extends from the lower end of cylinder 30 and a suction cup 34 is attached to the lower end of the piston. In this connection, a vacuum line 36 applies suction to cup 34 as will be described forthwith. Piston 32 is disposed for vertical movement within cylinder 30 between a lowered position wherein the suction cup rests on top of the stack to a raised position. As will be described in detail forthwith, the piston is also adapted to move to an upper position, above the raised position, under proper circumstances. The piston is actuated in a conventional manner by fluid or compressed air entering and exiting the cylinder such as through line 38.

The third section of the mechanism is generally designated by the numeral 40. This section comprises a first cylindrical roll 42 along with a plurality of additional similar rolls 44. The rolls are driven by a motor 46 which may be either a conventional electrical motor or an air driven motor. The advantage of the latter type motor is that it can absorb quick stops without danger of burnout. In either event, as shown, several of the rolls are driven by the motor through a chain mechanism 48. It should also be noted that the roller means 40 is elevated with respect to the stack of sheets 12 so that each individual sheet 14 must be raised as well as moved horizontally in order to transport it from the stack on bed 18 to the roller means 40.

As shown, cylinder 50 is mounted to the mechanism frame above the first roll 42. A piston 52 extends downwardly from the cylinder and a pinch roll 54 is secured to the bottom of piston 52. The piston 52 is actuated in a conventional manner by fluid or compressed air entering and leaving the cylinder. When piston 52 is in its downward position, the pinch roll 54 cooperates with the first roll 54 in capturing a sheet of steel therebetween so that the rotation of the first roll drives the sheet along the roller means.

The fourth section of the mechanism is generally designated by the numeral 56 and comprises a lifting station aligned with the power brake 16. The lifting station comprises a bed 58 of free turning cylindrical rolls 60. The bed is supported by a pair of pistons 62 which extend from cylinders 64 and together define an elevator for lifting the bed from a first position level with the roller means 40 to a second position level with the inlet 66 to the power brake. When the bed is in the second position, a single operator can easily slide a sheet resting thereon into the power brake for forming. When the bed is in the first position, the driving action of the roller means 40 feeds a sheet from the roller means onto the bed. In this connection, a stop 80 limits the movement of the sheet on the bed.

Figure 2:
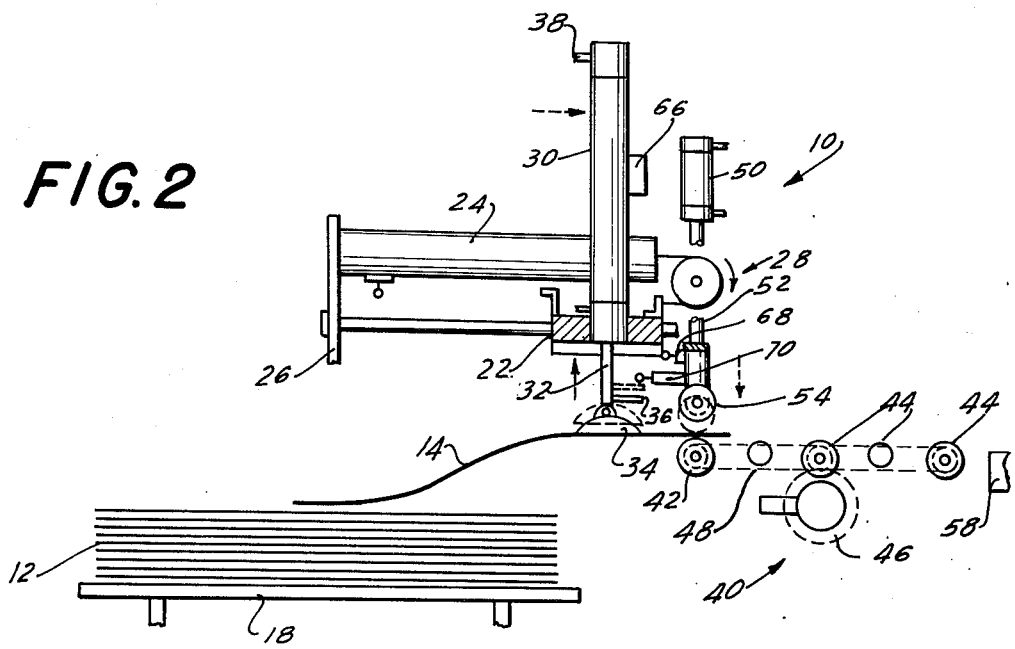
FIGS. 2 and 3 are detailed diagrammatic views of the first and second sections of the mechanism during various stages of operation.
Figure 3:
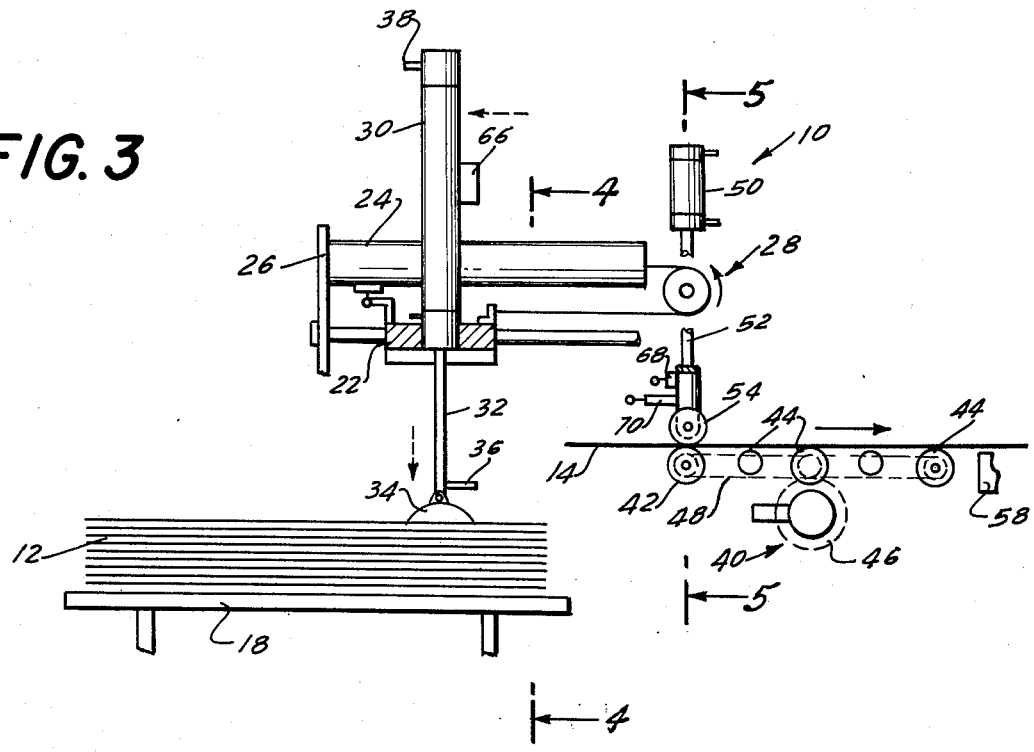

Additional features of the present mechanism will be discussed in conjuction with the following description of its operation. In use, a stack of sheets 14 is placed on bed 18 and the machine is actuated. In the initial position, the trolley 22 is in the rearmost (i.e., furthest away from brake 16) position, as shown in FIG. 3. Piston 32 is lowered and suction is applied to cup 34 to engage the top sheet 14 of the stack. Thereafter, piston 32 is raised and the trolley is moved toward the power brake as shown in FIG. 2. In order to ensure sufficient vacuum within the cup to secure sheet 14 while the piston and trolley move, the pressure within the suction cup is monitored and fed to a sensing switch 66 such as a "Honeywell Pressuretrol" switch manufactured by the Minneapolis Honeywell Company. This switch is a vacuum controlled mercury switch and its purpose is to ensure that sufficient vacuum is applied to the suction head before the head moves upwardly thereby ensuring that sheet 14 will be engaged by the switch. Thus, until the pressure within the suction cup is sufficient to hold a sheet 14, switch 66 inhibits the upward movement of piston 32 and horizontal movement of the trolley.

After piston 32 moves upwardly to the raised position, the trolley moves toward the power brake until the front of the trolley engages switch 68 mounted on piston 52 above pinch roll 54 as shown in FIG. 2. When switch 68 is engaged several things happen. In the first place, the vacuum is released from cup 34 so that sheet 14 disengages from the cup. At the same time, the piston is again actuated to move upwardly to an upper position (above the raised position) so that the suction cup moves upwardly a slight distance to clear the sheet (as shown in phantom in FIG. 2). This preserves the life of the suction cup by ensuring that the sheet and suction cup are completely disengaged before the roller means starts moving the sheet horizontally. As the piston moves upwardly, the pinch roll mechanism is energized and its piston 52 is lowered (to the position shown in phantom in FIG. 2) to capture sheet 14 between the pinch roll and first roll 42. In addition, motor 46 is turned on actuating the roller means 40.

Sheet 14 is thus free of the lifting mechanism 20 and driven by the rollers toward the power brake. As stated, the reason the suction cup is raised above its upward position is to ensure that the cup is separated from the sheet before the sheet is driven toward the brake. To this end, a second switch 70 is mounted to the pinch roll piston 52 as shown and it is not until this switch is engagged (as shown in FIG. 2) by the further upward movement of the suction cup that the pinch roll comes down to secure the sheet on the rolls.

Sheet 14 is driven by the rolls from the roller means 40 to the rolls 60 on elevator bed 58, as shown in FIG. 6. In this connection, a safety switch 72 is mounted to the frame to sense when the bed is in its lowered position. That is, when the bed is in the position shown in FIGS. 1 and 6 the rolls 60 generally align with rolls 42 and 44 so that sheet 14 may smoothly transfer from the roller 40 to the rolls 60 of the elevator bed. When the elevator is raised, it lifts of switch 72 (as shown in FIG. 7). This actuates switch 72 to interrupt the power circuit to motor 46 thereby stopping roller 40. Thus, switch 72 serves to prevent a sheet which otherwise would be driven by the rolls of means 40 onto the position of the elevator bed from damaging the pistons 62 of the elevator when the elevator is in the raised position. A stop 80 limits the movement of a sheet of steel on the elevator bed.

When sheet 14 is in position on the elevator bed 58 as shown in FIG. 6, its presence is sensed by a proximity sensor 74 which may, for example, comprise a magnetic steel detector. The presence of sheet 14 over sensor 74 serves to stop motor 46 and raise the elevator bed 58 from its lowered position (shown in FIG. 6) to the raised position (shown in FIG. 7). The operator may then slide the sheet into press 16 (into the plane of the paper) and actuate the press in a conventional manner such as by actuating a foot control 76 thereby forming the sheet as shown in FIG. 8. Additional pressing operations may also be performed if required. The elevator bed 58 remains in the raised position for a fixed period of time during which the operator activates the press to bend to sheet steel as required as shown in FIG. 8. Thereafter, the bed lowers to its initial position thereby permitting the next cycle of the machine to occur.

Thus, in accordance with the above, the aforementioned objects are effectively attained.

Having thus described the invention, what is claimed is:

1. A feed mechanism for a power brake or the like comprising:

a frame;

means for supporting a stack of sheets to be fed to said power brake;

means secured to said frame for lifting a single sheet vertically from said stack and for transporting said sheet horizontally to a roller means, said lifting means comprising a trolley mounted to said frame for horizontal movement between a first position over said stack support and a second position, means for driving said trolley between said first and second positions, a cylinder mounted to said trolley for movement therewith, a piston disposed within said cylinder for vertical movement, said piston having a lower end extending out of the bottom of said cylinder, means for moving said piston within said cylinder between a lowered position and a raised position, suction cup means affixed to said piston lower end, and means for applying and removing suction from said suction cup;

roller means for transporting said sheet horizontally to a lifting station, said roller means including a first roll substantially aligned with said trolley second position and affixed to said frame at a height substantially equal to the level of said suction cup when said piston is in said raised position, a plurality of additional rolls extending between said first roll and said lifting station, means for driving said rolls, a pinch roll mounted to said frame for vertical movement aligned with said first roll, means for moving said pinch roll vertically between an upward position spaced apart from said first roll and a downward position, switch means in controlling relationship with said pinch roll moving means and disposed in the path of movement of said trolley, said switch means being operative to cause said pinch roll moving means to drive said pinch roll to said downward position when said trolley is in said second position;

a lifting station adjacent said power brake, said station including an elevator bed for receiving said sheet and raising said sheet from a first level equal to that of the roller means to a second level above said first level and substantially equal to that of the power brake inlet; and, means for driving said elevator bed.

2. The mechanism in accordance with claim 1 wherein said switch means is in controlling relationship with said suction applying means, said switch means being operative to remove suction from said cup when said trolley is in said second position.

3. The mechanism in accordance with claim 1 wherein said piston moving means is adapted to move said piston to an upper position above said raised position, said switch means is in controlling relationship with said piston moving means, said switch being operative to activate said piston moving means to raise said piston from said raised position to said upper position.

4. The mechanism in accordance with claim 3 further comprising second switch means disposed in the path of movement of said piston from said raised position to said upper position, said second switch means being operative to actuate said roll driving means.

5. The mechanism in accordance with claim 4 further comprising third switch means secured to said frame in the path of movement of said elevator bed, said third switch means being in controlling relationship with said means for driving said rolls and adapted to actuate said aforementioned means only when said elevator bed is at said first level.

6. The mechanism in accordance with claim 1 further comprising vacuum monitoring means operatively attached to said suction cup and control means responsive to said vacuum monitoring means in controlling relationship with said piston moving means, said control means being biased to maintain said piston in said lowered position until said vacuum monitoring means measures a predetermined pressure within said suction cup.

7. The mechanism in accordance with claim 1 further comprising sheet sensing means affixed to said elevator bed, and switching means operatively controlled by said sensing means, said switching means being in controlling relationship with said elevator bed driving means.

8. The mechanism in accordance with claim 1 wherein said elevator bed comprises a plurality of rolls.

* * * * *